United States Patent [19]

Baumann

[11] 4,038,521

[45] July 26, 1977

[54] AIMING DEVICE FOR FIRING ON MOVABLE TARGETS

[75] Inventor: Martin Baumann, Muri, near Bern, Switzerland

[73] Assignee: Sperry Rand Corporation, New York, N.Y.

[21] Appl. No.: 636,903

[22] Filed: Dec. 3, 1975

[30] Foreign Application Priority Data

Dec. 11, 1974 Switzerland ..... 16345/74
Nov. 20, 1975 Switzerland ..... 15083/75

[51] Int. Cl.[2] ..... F41G 5/08; G06F 15/58; G06G 7/80

[52] U.S. Cl. ..... 235/61.5 S; 33/238

[58] Field of Search ..... 33/238; 235/61.5 S

[56] References Cited

U.S. PATENT DOCUMENTS

| | | | |
|---|---|---|---|
| 3,091,035 | 5/1963 | Kuhlenkamp | 33/238 |
| 3,263,566 | 8/1966 | Eglin et al. | 33/238 |
| 3,638,321 | 2/1972 | Eglin | 33/238 |
| 3,798,420 | 3/1974 | Kaaz | 235/61.5 S |
| 3,845,276 | 10/1974 | Kendy et al. | 235/61.5 S |

*Primary Examiner*—R. Stephen Dildine, Jr.
*Attorney, Agent, or Firm*—Howard P. Terry

[57] ABSTRACT

A system for aiming a weapon such as an antiaircraft gun at a target which includes in combination an optical sighting mechanism having a movable reticle and a movable target mark associated with the movable reticle, digital to rotational motion transducers coupled to the movable reticle and the movable target mark and a digital computer adapted to receive inputs indicative of the azimuth and elevation of the target as well as its estimated velocity and ballistic characteristics of the ammunition used. The computer is programmed to compute the flight path of the target and a lead angle based upon certain trigonometric relationships and provides a digital output to the digital-to-rotational motion transducers to position the reticle and target mark in the optical sighting mechanism.

3 Claims, 8 Drawing Figures

AIMING DEVICE FOR FIRING ON MOVABLE TARGETS

BACKGROUND OF THE INVENTION

The invention relates to an aiming device for improving the aiming or firing on movable targets, particularly airborne targets, by means of which the so-called apparent direction of flight, defined by the target course, and the lead angle or the components thereof (by azimuth angle as well as the so-called super elevation), are determined.

Such a device is particularly suitable for use in connection with antiaircraft weapons and may be mounted directly on guns, as a so-called lead calculator, and may also be used for central firing control equipment.

When firing on movable targets, the weapon must be pointed ahead of the target, that is, set to the so-called lead point, which is located ahead of the target on the target course on which the target will be located after lapse of the projectile flight time, provided the target has not changed its path.

In addition, the gun barrel must be raised by the super elevation angle measured with respect to the sighting beam, so that the projectile will fly to the predetermined lead point.

A device is known, in which the so-called flight plane defined by the assumed straight line of this target course and the equipment site is determined by two sighting beams originating from the position of the equipment tracking each momentary position of the target, whereby mechanical elements associated with the sight beams for the purpose of fixing the setting plane in the equipment according to the flight plane may be adjusted by directional motions. Such a device has been described in the German Pat. Specifications No. 953047. Under the present state of the art, devices for determining the lead point in the flight plane, in which the lead angle is determined, at least partially, by mechanical reproductions in the lead triangle are known. Such a device is described in the Swiss Pat. Specifications No. 369383.

However, these devices exhibit various shortcomings. For instance, the apparent direction of flight can be determined precisely only if the target changes from the first sighting beam by an angle of a minimum value, whereagainst this device fails, due to mechanical reasons, in "near approaches". Additionally, the plane of observation in this device must initially be coarsely adjusted to the projected motion of the target, thus causing a certain loss of time. The prior art device for determining the lead angle performs theoretically exact calculations only for horizontal target paths and not for inclined target paths. For mechanical reasons it fails when an elevation angle is small.

Pursuant to the invention, the aiming device for improving the aiming or firing on movable targets, especially flying targets, is characterized by the combination with a sight device being capable of sensing and measuring succeeding positions of a target in space by azimuth and elevation angle of a computer having a memory unit for storing data obtained from the measuring of the azimuth and elevation angle of at least one position of a target in space picked up by means of the sight device (first determining beam), and for storing a program for manipulating trigonometric and spherical relations relating to straight flight paths, as well as the interrelationships of the ballistic characteristics of the ammunition used, (firing angle and projectile flight time and, respectively, average projectile velocity), of a device for the input of an estimated or otherwise determined target distance into the computer, of a device for the input of an estimated or otherwise determined target velocity into the computer, all of it arranged in such a cooperation that the computer determines the apparent direction of the reference plane, defined by the two beams by means of data obtained by the first determining beam of the picked-up target, and by data of the momentary direction of the sighting beam (second determining beam) obtained from the measuring device, whereby this direction merges with the desired apparent flight direction of the target, if it is sighted at any given point of this apparent flight direction. In addition, the computer determines the lead angle or its components with respect to azimuth and elevation in the flight plane, as well as the firing angle.

The computations are thus based on two sighting beams from the aiming device whereby the specific values (azimuth and elevation angle) are constant in the first determining beam and variable with the second determining beam depending on the directional motion of the aiming device. It is important to note that those two determining beams define an imaginary plane which may be characterized as a setting plane, which the sensor, i.e., the eye perceives as a straight line of setting and which rotates about the point fixed by the first sighting beam when the sighting device is moved, i.e., this point constitutes the conversion point of all straight setting lines. The setting plane merges with the flight plane as soon as the target is sighted with an arbitrary point of the straight reference line, thus determining the apparent flight-direction.

The sensor, i.e., the starting point of the target sensing beams or sighting beams, is usually the eye of the curious observer, but purely technical devices, such as radar, may also be used for detection.

OBJECTS

It is accordingly an object of the present invention to provide a new and improved aiming mechanism for sighting and firing upon moving targets.

Another object of the invention is to provide a gun aiming system which involves the use of a high speed digital computer to determine a flight path and lead angle of an aircraft and whose output is used to adjust the reticle and firing point of an optical sighting mechanism.

DESCRIPTION OF DRAWINGS

These and other objects of the invention will become apparent from a reading of the following detailed description of the preferred embodiment, especially when considered in light of the following drawings in which.

DESCRIPTION OF PREFERRED EMBODIMENT

Figure 1:
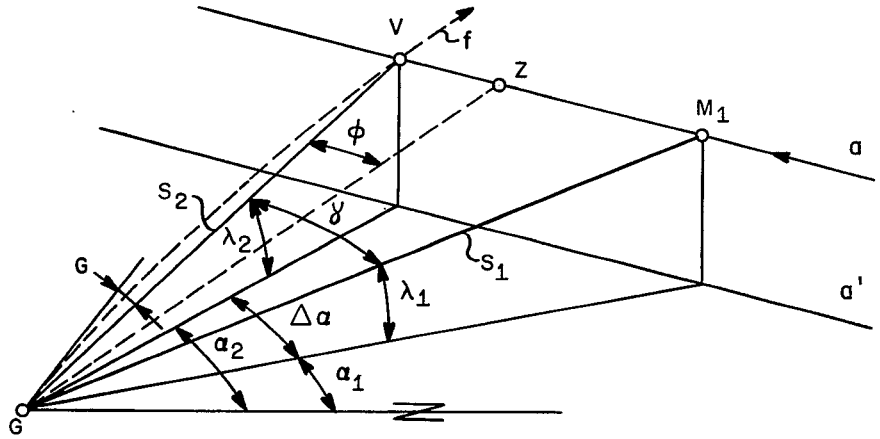
FIG. 1 shows the geometry of the target motion in trigonometric representation.

In FIG. 1 the site of the weapon, e.g., an aircraft gun is indicated by the letter G. The path of a target flying from the right to the left is indicated by vector *a*. It should be noted that G and a define the so-called flight plane. The projection of the straight target path line *a* on a horizontal plane is indicated by line *a'*. $M_1$ indicates a point on the target path *a* at which the flying target has first been sighted from the gun location G. An imaginary line connecting G with $M_1$ is designated the first sighting beam $S_1$ which has an azimuth angle $\alpha_1$ from the zero direction N and an elevation angle $\lambda_1$ from the horizontal plane.

At a later time, when the projectile is fired, the target will be located at target point Z. Located ahead of the target point Z on the target path line a is the lead point V towards which the gun must be directed, but raised by the super elevation angle $\delta$. An imaginary line connecting G with V is herein called the second sighting beam $S_2$. The second sighting beam has an azimuth angle $\alpha_2$ and an elevation angle $\lambda_2$.

As will be seen later, at the moment of the second sighting, the projectile will be fired. At this moment the target is still located at the target point Z and the angle between the sighting beam $S_2$ and the line GZ is called the lead angle $\phi$. Just for the sake of completeness it may be recalled that, at the time of firing, the gun axis is not directed to point V but is raised somewhat above point V by the super elevation angle $\delta$ to take into account the parabolic flight path f of the projectile as indicated on the drawing.

Before considering the aiming device in detail, it will be helpful to consider the aiming procedure with help of an optical reflex system. However, it should be noted that any kind of a suitable aiming device may be used.

Figure 3:
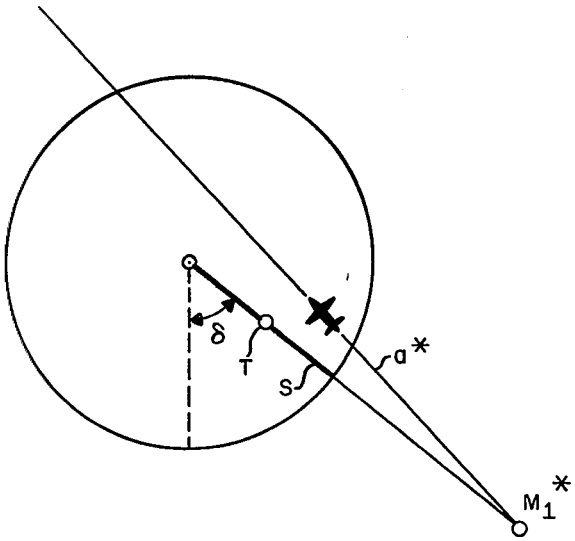
FIG. 3 shows the field of view with the use of a reflex lens, the target being visible but not aimed by the target mark.

FIG. 3 shows the field of view with the aid of an optical reflex system. The center point represents the optical axis (sighting beam $S_2$ on FIG. 1) which is to be aligned at the time of firing with the lead point V, the gun barrel being raised in known fashion by the super elevation angle $\delta$ in relation to the sighting beam. The radial line s represents the setting plane, which is defined by the first sighting beam $S_1$ and the momentary location of the sighting beam when the sighting device is moved. $\delta$ designates the angle between the apparent direction of setting plane and a vertical line shown by dashes in FIG. 3. Whereas in FIG. 1 the setting plane coincides with the flight plane, this is not yet the case in FIG. 3. The flight plane is indicated as a line*a**, still inclined with respect to the setting plane which is also indicated as a line, both lines crossing at $M_1$ lying, in this example, outside of the view of the aiming device.

Figure 4:
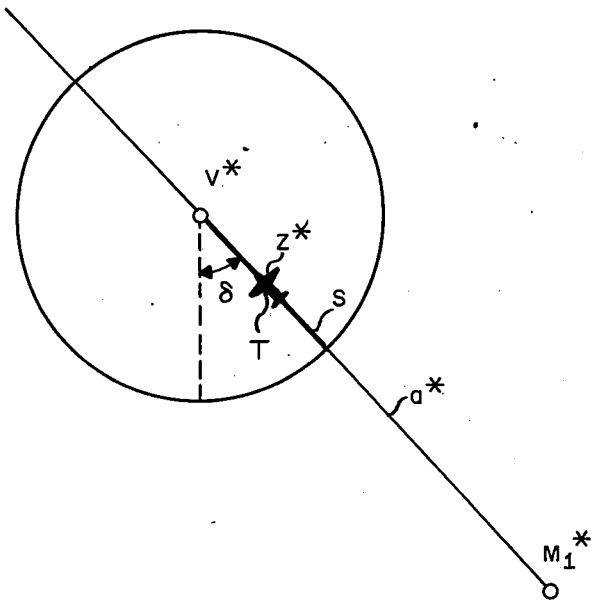
FIG. 4 shows the same field of view, but with the target being aimed with the target mark.

To aim the gun to the lead point V, the line *s* is brought on the target Z* and in particular, the marker T is set on the target Z* as shown in FIG. 4. Now firing may take place. FIG. 4 corresponds to the situation shown in FIG. 1, i.e., the direction defined by the marker T corresponds to the line GZ, and the sighting beam 43, in FIG. 5, corresponds to the line GV, with respect to which the gun barrel is elevated by the super elevation angle $\delta$.

Figure 2:
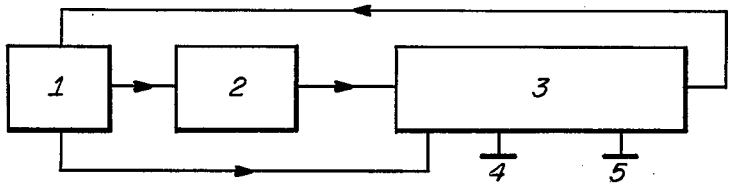
FIG. 2 shows a block diagram of the sighting system.

Now, after having considered the geometry of target motion as disclosed in FIG. 1 and an example of a visual representation by an optical reflex system as shown in FIG. 3 and 4, the aiming device shall now be discussed with reference to a block diagram shown in FIG. 2.

The sight device 1 is equipped with means (not shown) to sense and measure the azimuth and elevation angle of the target. Means to convert angular movement into digital or analog signals are well known in prior art. A computer includes a memory unit 2 and computing means 3. The memory unit 2 serves to store data obtained from measuring azimuth $\alpha_1$ and elevation angle $\lambda_1$ of the first determining beam $S_1$ (FIG. 1). Data input means 4 is provided for feeding the estimated or determined target distance into the data processing device. A further data input means 5 serves to feed the estimated or determined velocity of target data into the computing means. The memory 2 further serves to store programmed mathematical relations concerning straight flight path as well as a mathematical interrelationship of the ballistic properties of ammunition used.

By means of the azimuth angle $\alpha_1$ and the elevation angle $\lambda_1$ stored in the memory 2 and the input values of azimuth and elevation angle continually measured by the sight device 1, the computer determines the apparent direction of the setting plane and within the latter, the lead angle $\phi$. The lead angle $\phi$ is obtained by using the input values for the target distance and the target velocity as well as the stored ballistic data of the ammunition. It should be recalled at this point, that the setting plane is defined by the first sighting beam $S_1$ and the momentary location of the sighting beam when the sighting device is further moved. During this movement the computer continuously computes the corresponding lead angle $\phi$. If the target is now sighted on any arbitrary point of the apparent direction of the setting plane, the latter will merge with the flight plane. Also the lead angle $\phi$ will have the value required for the projectile.

Figure 5:
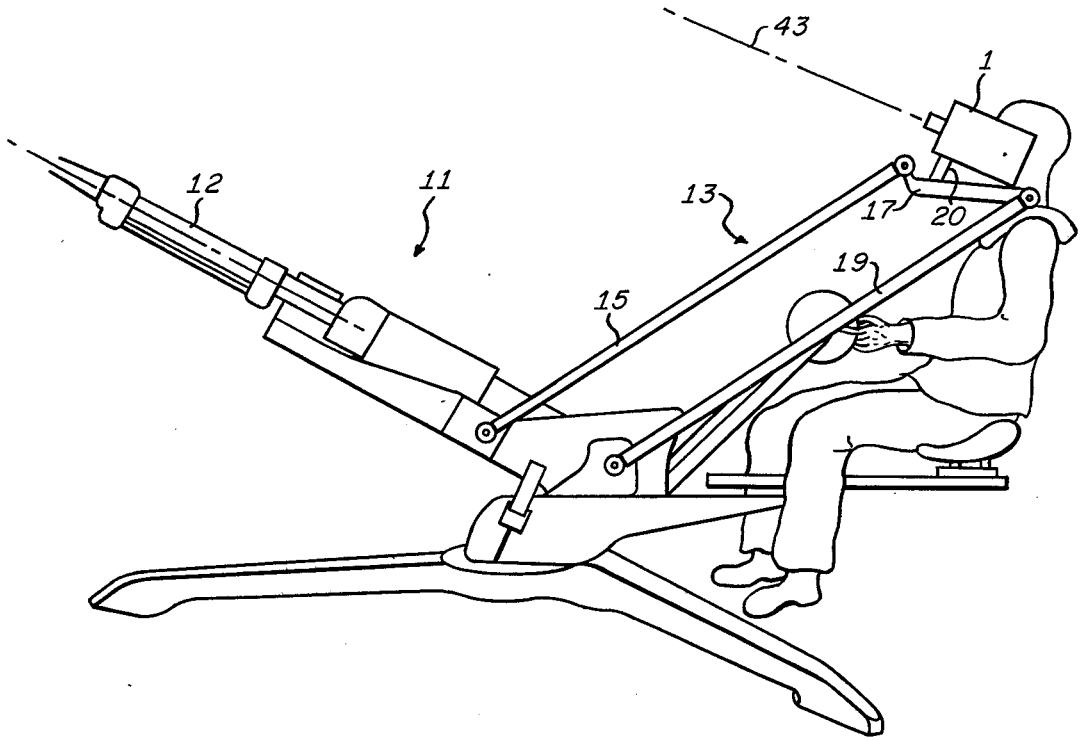
FIG. 5 shows the attachment of an aiming device on an aircraft gun.

As FIG. 5 shows, the sight device 1 is located on an antiaircraft gun 11 by means of a parallel guide 13, consisting of levers 15, 17 and 19. Accordingly, the sight device will follow the motions of the gun 11 as is well known. Therefore, at a super elevation angle of zero, the axis 12 of the gun barrel and the sighting beam 43 will always be parallel. However, means 20 controlled by the computer are provided on the aiming device 1 to lower the sight device according to the super elevation angle $\delta$ (FIG. 1). Said means 20 consist of a device transforming electric signals into a corresponding angular motion as well known in the art.

Because the distance of gun axis 12 and sighting beam 43 is small, it may be neglected for practical purposes, and in FIG. 1 both gun axis and sighting beam may be considered to originate from one point G.

The optical reflex system 21 (FIGS. 6–7) has a reticle 23 located in a ball bearing 25 and capable of being rotated on the optical axis 27. The rotation of the reticle 23 takes place according to the apparent direction of the setting plane computed by the computer. For this purpose, an encoder 29 transforms information from the computer into a rotational movement. An instrument stepper motor, such as the model 11 MRA-AC3-DO manufactured by Vernitech, Inc., may be used as the encoder drive motor. The movement of the encoder 29 is transmitted over gear 31 to the gear 33 in which the reticle 23 is located.

The convex reticle 23 is opaque with exception of a radial line or slot 35 (FIG. 7) and a center circle 37. According to the known principle of a reflex sight, this radial line 35 is projected by means of a light source (not shown) to a transparent mirror 36 in the field of view of the sight device where it is visible to the eye 39 of the observer. It is seen as line *s* in FIGS. 3 and 4. The visible center circle 37 represents the optical axis 27 of the sight device or the sighting beam 43 being located at a right angle to the optical axis and corresponding to a super elevation zero of the gun. Therefore, the observer sees on the transparent mirror 36 the projected radial line and the center circle as well as the target visible through the transparent mirror. It is the purpose of the encoder 29 to transform the computed values of the apparent direction of the setting plane into a rotation whereby the reticle 23 is moved by the same angle.

Fixed on the ball bearing 25 is a bushing 45 on which the reticle 23 and the gear 33 is mounted. The bushing also supports a bearing 47 in which a shaft 49 parallel to the optical axis 27 is pivotally movable. Mounted at one end of the shaft 49 is a thin rod 28, which, on a rotation of the shaft 49, glides over the reticle 23 to interrupt at the position crossing the radial line or slot 35 (FIG. 7) the light falling through the slot and creating a gap serving as target mark, T, for firing.

Figure 8:
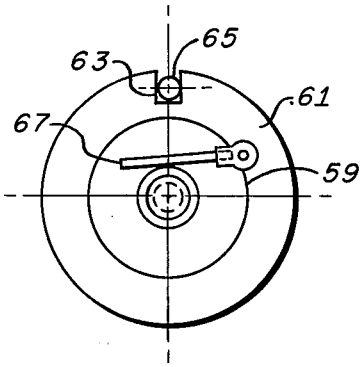
FIG. 8 shows a detail from FIG. 6.

In order to move the target mark, T, away from the center circle 37 according to the lead angle $\phi$ computed by the computer, a second encoder 53 is provided which transforms the values of the lead angle $\phi$ or a function thereof into an angular displacement. An exemplary encoder device which may be utilized in the system of the present invention is an optical shaft angle encoder (Model DRC 29) manufactured by the Dynamics Research Corporation. The shaft 55 of the encoder 53 is provided with a lead screw 57 on which a conical member 59 is threaded. The conical member 59 has a flange 61 comprising a radial slot 63 (FIG. 8) into which a stationary pin 65 engages. Accordingly, on an angular motion of the shaft 55 the conical member 59 makes only an axial movement back or forth, as indicated by the porition of the conical member shown by dotted lines.

At the outer end of the shaft 49 is mounted a pin 67 at a right angle to the shaft 49. This pin 67 is biased by spring means (not shown) against the conical surface of the conical member 59.

On an axial movement of the conical member 59 the pin 67 glides on the conical surface of the conical member 59, so that the thin rod 28 is moved in such a way that on the reticle 23 the distance between the target mark, T, from the center circle 37 corresponds to the lead angle $\phi$ calculated by the computer. As the encoder 53 is located coaxially to the optical axis 27, also on a rotation of the reticle 23, the pin 67 will always sense the same value from the conical member 59. In other words, also on a rotation of the reticle 23 the target mark, T, always will remain at the same distance from the center circle 37.

Figure 6:
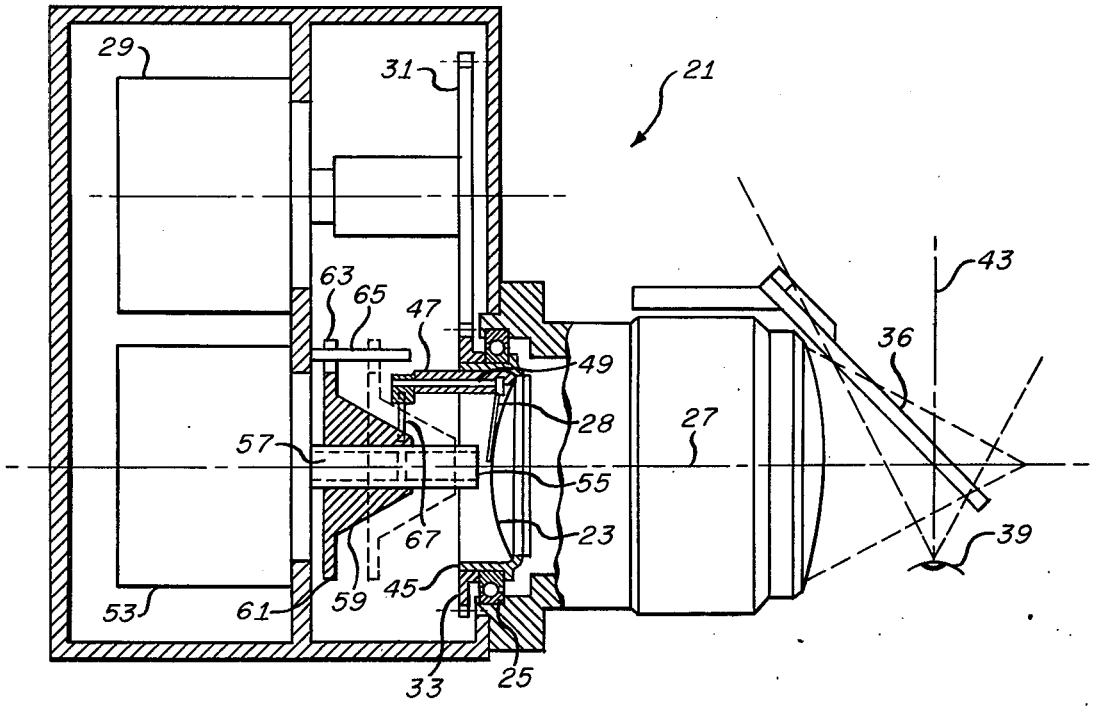
FIG. 6 is a view from the top, in section, on an embodiment of an aiming device according to the section line 6 — 6 of FIG. 7.
Figure 7:
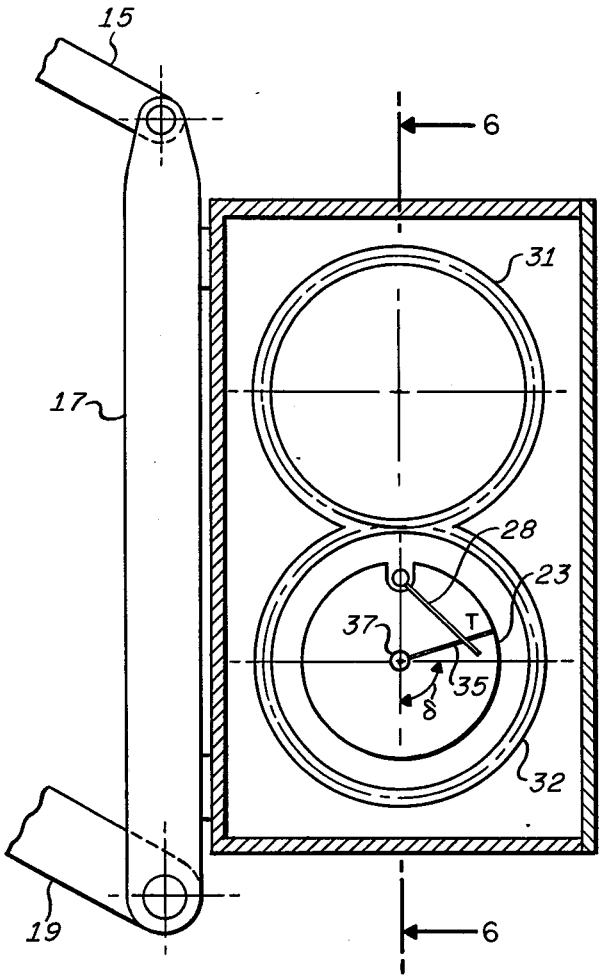
FIG. 7 shows a side view of the aiming device, partially in section.

As is shown in FIG. 6 of the drawing, the member 59 is of conical form. However, it will also be possible to provide the mantle line of the member 59 as a predetermined curve which will permit to adapt the geometric conditions to the arrangement of the movable parts, and to consider eventually a certain function of the lead angle, for example the transformation of sin $\phi$ into $\phi$.

Pursuant to the invention, the following mathematical equations may be programmed into the computer (3) for the execution of the calculations. It is felt to be within the abilities of those of ordinary skill in the art of programming digital computers to be able to construct a program which will solve the trigonometric equations set forth herein. The angle $\gamma$ in the setting plane (FIG. 1) between the two sighting beams may be determined from the specific values of the two sighting beams $S_1$ and $S_2$ and may be expressed, as follows:

$$\cos \gamma = \sin \lambda_1 \,.\, \sin \lambda_2 + \cos \lambda_1 \,.\, \cos \lambda_2 \,.\, \cos \Delta\alpha \qquad (1)$$

whereby $\Delta\alpha$ defines the lateral difference of the two sighting beams.

The equation $$\sin \delta = \frac{\cos \lambda_1 \cdot \sin \Delta\alpha}{\sin \gamma} \qquad (2)$$

may be used to determine the angle of the apparent direction of the setting plane and, respectively, the apparent flight direction.

If the airborne target moves on a horizontal straight path *a,* the lead angle $\phi$ is determined by the equipment location G, the target position Z, and the lead point V, that is, the lead angle $\phi$ is located opposite the lead distance ZV which may be conceived as the radius of a horizontal circle exhibiting the lead point V as the center, and representing the geometrical site of all possible target positions to the lead point V at a determined target velocity V and a determined projectile flight time $\tau$ from G to V. As observed from the location G, this imaginary circle appears as an ellipse, so that the equation $$\sin \phi = \frac{v \cdot \tau \cdot \sin \lambda_2}{E_z \sqrt{1 - \cos^2 \lambda_2 \cdot \sin^2 \delta}} \qquad (3)$$

may be used to determine the lead angle, whereby $v$ defines the target velocity, $\tau$ the projectile flight time from G to V, and $E_Z$ the target distance GZ, and whereby the value for sin $\phi$ may be substituted approximately by $\phi$.

The flight time $\tau$ of the projectile depends on the ballistic properties of the ammunition used and on the impact distance $E_V$ which may be determined by the equation $$E_V = E_Z \cos \phi - \frac{v\,\tau \cdot \cos \delta \cdot \cos \lambda_2}{\sqrt{1 - \cos^2 \lambda_2 \sin^2 \delta}} \qquad (4)$$

In other possible embodiments of the sight device, to which reference will be made later on, e.g., a dot of light is projected to indicate the target mark, T, according to azimuth and height, or a telescope is extended, the respective lead components may be determined by the following:

$$\kappa = \phi \,.\, \sin \delta \text{ for the azimuth} \qquad (5)$$

or $$\eta = \phi \,.\, \cos \delta \text{ for the elevation} \qquad (6)$$

From the multitude of the trigonometric and spherical relations, equations other than those given here may, of course, be used for the calculation of the values sought, and in addition, depending on the intended use of the respective weapon and the required accuracy of calculation, simple approximation equations which require less of an effort for realization may be used.

It is thus possible to determine the apparent flight direction through a single expression, as follows:

$$\text{tg}\ \delta_2 = \frac{\text{ctg}\ \lambda\ 1 \cdot \sin \Delta\alpha}{\cos \lambda_2 - \text{ctg}\ \lambda_1 \cdot \sin \lambda_2 \cos \Delta\alpha} \quad (7)$$

A further variation exists, whereby an auxiliary angle $\mu$ according to equation $\text{tg}\mu = \text{ctg}\ \lambda_1 . \cos \Delta\alpha$ (8)

is determined at first, which may be used to determine the direction of the apparent flight direction by the equation, as follows:

$$\text{tg}\ \delta_2 = \frac{\sin \mu \cdot \text{tg}\ \Delta\alpha}{\cos (\lambda_2 + \mu)} \quad (9)$$

By programming suitable mathematical interrelationships it is furthermore possible to determine precisely the lead values for inclined flight paths by putting into the computer 3 an estimated or otherwise determined angle of inclination by means of a device not shown in the drawing. The accuracy of the determined lead values is, of course, dependent on the quality of the estimate for the accuracy in determining the angle of inclination.

The operation of the device described above for determining the apparent flight direction defined by the target path and the lead angle or of the lead components in azimuth and elevation is, as follows:

By means of the device 4, estimated or otherwise determined values for the normally constantly changing target distance ($E_Z$), are inputted into the computing means 3 in digital form, and by means of the input device 5 an estimated or otherwise determined value for the target velocity is likewise imposed. The target will now be sighted with the aiming axis of the sighting device by appropriate moving of the device in azimuth and elevation, whereby the respective specific values ($\alpha_1$, $\lambda_1$) of the first sighting beam $S_1$ to the memory unit 2, store them, and feed the data into computing means 3. The sight device is thereupon rotated according to the target motion, whereby the respective specific values ($\alpha_2$, $\lambda_2$) are measured continuously and feed into the computing means 3, which determines the apparent direction of the setting plane by means of the equations 1 and 2, the lead angle $\phi$ by means of the equation 3, or the lead components $\kappa$, $\eta$ in azimuth and elevation, furthermore the distance $E_v$ of the led point V, and from the latter the projectile flight time to the lead point, by means of the equation (4), whereby the projectile flight time in turn is added to the equation (3). The values $\phi_1$, $\delta$ used to move the target sight line *s* and the target mark, T, are transferred to the sighting device (FIG. 6) where the encoders 29 and 53 set the reticle and the target mark. As soon as the target is sighted at any arbitrary point of the target sight line *s* (FIG. 4), the setting plane corresponds to the desired flight plane, i.e., the target sight line *s* indicates the apparent flight direction, whereupon the target mark, T, is to be aligned with the target and firing can occur (FIG. 4).

It is immaterial how the device is moved between the individual sightings, i.e., it is unnecessary to point it continuously towards the target, as is the case with various other known gunsights, thus reducing demands on sighting activity and also permitting a much faster readiness for firing and quicker followup barrages.

Depending on the circumstances, sighting with the target mark, T, will vary. During the follow-up firing procedure, the target mark must be lined up with the target as closely as possible, whereby no great expectations should be placed on hitting the target due to the only approximate determination of the lead angle by extimates of target velocity and target distance. To overcome this deficiency, it has already been suggested to use a control device for the purpose of temporarily influencing the size of the lead angle determined, resulting in a back and forth movement over the target.

When a so-called barrage is directed at the target, the target mark, T, must be aligned with the target only on firing the first shot of a series. In order to be able to obtain too large a lead, at the start, so that the first shot will presumably pass ahead of the target, respectively that the target is caught in the fire, it is expedient to increase the flight time of the projectile $\tau$ in the equation (3) by a definite value which corresponds roughly to half the duration of a series of shots.

In the event that the target changes direction, the sighting line *s* will no longer agree with the apparent flight direction. In order to avoid a repetition of the process of determination, it is envisioned, according to the invention, to store data of additional measurements of specific values of target positions, thus making it possible to use data of a subsequent measurement as a new first determining beam for further determinations. Every time the aiming process has been completed, the stored data are to be cleared from memory.

The nature of the present invention makes possible a large number of variations in the design and operation of the aiming device with a variety of designs and means of operations of sighting devices possible, without thereby deviating from the idea of the present invention.

Thus, for instance, the computing means 3 may be a digital binary computer. The same calculations may, of course, be carried out by means of other types of calculators, providing that the necessary calculations can be carried out instantaneously.

It is also possible to use a telescope in lieu of an optical reflex system, which has the means to either indicate the target mark, T, in the telescope, or to deflect the optical axis of the telescope by known means towards the direction conforming to the direction of target mark, T. The same applies also to devices which use a periscopic sight for aiming at the target.

It would also be possible to use an optical reflex system, in which the target mark, T, is indicated by means of a strobe light and where the light beam indicating the target mark, T, may be deflected periodically for short periods in a radial direction, in order to indicate a sighting line *s*. Such a system is suggested by Swiss Pat. No. 474738. This makes it easier for the gunner to align the target A, by pointing this line at first towards the target with too large a lead, permitting the target on this line to fly into the target mark, T, and to open fire.

A variation for determining the lead angle consists of a calculation based on an estimated distance $E_v$ to the lead point V instead of the target distance $E_z$, taking into consideration, depending on the flight position, that the selected distance to the lead point must, to a certain degree, be shorter in approaching flights, about the same in a passing flight, and greater than the distance to the target, when it is departing.

Pursuant to the invention, this can be expressed as follows:

$$\operatorname{tg} \phi = \frac{v \cdot \sin \lambda_2}{v_m \sqrt{1 - \cos^2\lambda_2 \cdot \sin^2\delta + v \cdot \cos \lambda_2 \cdot \cos \delta}} \quad (10)$$

whereby $v_m$ represents the average projectile velocity to the lead point $V$ which depends on the ballistic properties of the ammunition used. Since the average projectile velocity $v_m$ changes only slightly with the distance after firing, an error in estimating the distance to the lead point will have only a minor effect on the accuracy of the determined lead angle. It is, of course, also possible to determine the exact distance to the lead point V and thus the precise average projectile velocity $v_m$.

What is claimed is:

1. An aiming device for aiming a weapon at a moving target comprising in combination:

A. a gun sight device including
   1. means for measuring azimuth and sight angle of instantaneous positions of said moving target to establish an apparent path thereof;
   2. means to visualize a target mark positioned relative to a lead point such that the distance between said target mark and said lead point is representative of a lead angle; and
   3. signal controlled sight means to visualize said apparent path of said moving target and to set said target mark on said apparent path in accordance with said lead angle; and B. a data processing device connected to said gun sight device for receiving digital signals indicative of said measurements and capable of furnishing signals necessary for the control of said signal controlled sight means including
   1. means to store data of azimuth and sight angle of at least one instantaneous sighting of said moving target;
   2. means to store data concerning ballistic characteristics of the ammunition for said weapon;
   3. data input means adapted to receive digital signals representing target distance;
   4. data input means adapted to receive digital signals representing target velocity; and
   5. computing means to obtain from said angle data, said ballistic characteristics and said digital signals, control signals required to set said apparent path and said target mark in said signal controlled sight means.

2. Apparatus as in claim 1 wherein said signal controlled sight means comprises:

A. an opaque reticle having a transparent radial slot formed thereon mounted for rotation about a central axis;

B. first digital-to-rotational motion encoder means coupled to said reticle;

C. movable target marking means positioned to intersect said transparent radial slot; and D. second digital-to-rotational motion encoder means coupled to said target marking means for positioning the point of intersection on said transparent radial slot in accordance with said control signals from said computing means.

3. Apparatus as in claim 2 and further including means for applying said control signals to said first and said second digital-to-rotational motion encoder means.

* * * * *

UNITED STATES PATENT AND TRADEMARK OFFICE

CERTIFICATE OF CORRECTION

PATENT NO. : 4,038,521

DATED : July 26,1977

INVENTOR(S) : Martin Baumann

It is certified that error appears in the above-identified patent and that said Letters Patent are hereby corrected as shown below:

In the drawings, Sheet 1, Fig. 3, the airplane target should be referenced with Z*.

Column 1, line 11, insert --and elevation angle-- after "azimuth angle".

Column 2, line 30, "conversion" should read --converging--.

Column 3, lines 22, 33, 45 & 65, "angle $\delta$" should read --angle G-- for each occurrence.*

Column 3, line 55, "$M_1$" should read --$M_1$--.

Column 4, line 46, "angle $\delta$" should read --angle G--.

Column 5, line 38, "porition" should read --position--.

Column 7, line 31, "constantly" should read --continuously--.

Column 9, lines 1-5, formula (10) should read $$\operatorname{tg} \emptyset = \frac{V \sin \lambda_2}{V_m \sqrt{1 - \cos^2 \lambda_2 \sin^2 \delta} + V \cos \lambda_2 \cos \delta}$$

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*